US005203302A

United States Patent [19]

Parnitzke

[11] Patent Number: 5,203,302

[45] Date of Patent: Apr. 20, 1993

[54] OVERLOAD WARNING APPARATUS FOR INTERNAL COMBUSTION ENGINES

[75] Inventor: William A. Parnitzke, Sheboygan, Wis.

[73] Assignee: Tecumseh Products Company, Tecumseh, Mich.

[21] Appl. No.: 826,023

[22] Filed: Jan. 27, 1992

[51] Int. Cl.[5] ..... F02D 31/00

[52] U.S. Cl. ..... 123/376; 123/351; 364/565

[58] Field of Search ..... 123/376, 351, 349, 350; 364/426.04, 431.05

[56] References Cited

U.S. PATENT DOCUMENTS

| | | | |
|---|---|---|---|
| 705,514 | 7/1902 | Credlebaugh | 123/351 |
| 910,414 | 1/1909 | Perrin | 123/351 |
| 1,805,585 | 5/1931 | Knight | 123/351 |
| 2,983,911 | 10/1957 | Brafford | 340/264 |
| 3,281,783 | 10/1966 | Adams | 340/53 |
| 3,647,016 | 3/1972 | Fitzsimons et al. | 123/351 |
| 3,794,971 | 2/1974 | Hida et al. | 340/53 |
| 3,828,742 | 8/1974 | Weis | 123/351 |
| 3,868,855 | 3/1975 | Murphy, Jr. et al. | 73/530 |
| 4,025,897 | 5/1977 | Kisuna et al. | 340/52 R |
| 4,355,296 | 10/1982 | Drone | 340/52 R |
| 4,452,203 | 6/1984 | Oshika et al. | 123/376 |
| 4,532,901 | 8/1985 | Sturdy | 123/351 |
| 4,597,465 | 7/1986 | Burney | 123/351 |
| 4,631,515 | 12/1986 | Blee et al. | 340/62 |
| 4,644,334 | 2/1987 | Yato et al. | 123/351 |
| 4,725,969 | 2/1988 | Onogi et al. | 364/565 |
| 4,797,826 | 1/1989 | Onogi et al. | 123/351 |

*Primary Examiner*—Raymond A. Nelli
*Attorney, Agent, or Firm*—Baker & Daniels

[57] ABSTRACT

An overload warning apparatus for an internal combustion engine, wherein a switch is mounted adjacent the throttle control plate of the carburetor such that an outwardly extending leg of the plate engages and depresses a switch upon movement of the plate into its wide open position. Once depressed, the switch closes an electrical circuit to energize an indicator to alert an operator of the wide open throttle condition. Alternatively, the switch is located adjacent the governor lever of the engine such that the governor lever depresses the switch upon movement of the lever to a position causing the throttle plate to be moved into its wide open position.

10 Claims, 2 Drawing Sheets

OVERLOAD WARNING APPARATUS FOR INTERNAL COMBUSTION ENGINES

BACKGROUND OF THE INVENTION

The present invention relates generally to devices for providing an indication of an undesirable engine condition, and more particularly, to an overload warning apparatus for an engine.

Various apparatus are known in the art to indicate the engine speed of an internal combustion engine. These apparatus are generally designed to indicate when a maximum engine operating speed is exceeded by use of a visual or audio indicating device and may further operate to decrease the engine operating speed below the predetermined maximum speed.

U.S. Pat. No. 3,794,971 discloses a vehicle speed sensing device in which an alarm signal is activated when the speed of the engine exceeds a predetermined value. As the rotational speed of the shaft within the governor assembly increases, flyweights are caused to pivot outwardly and thereby move a sleeve member axially along the rotating shaft. The sleeve member in turn pivots a fork-shaped member having a pair of annular permanent magnets disposed therein and thereby urges the annular magnets into close proximity to a switching device having a reed switch therein. The switching device is connected via an electrical connection to an alarm which indicates that the vehicle's speed is approaching an upper speed limit. Thus, this patent provides an audio indication to a user who can then adjust the speed of the vehicle accordingly.

U.S. Pat. No. 2,983,911 also relates to an engine speed warning system for an internal combustion engine. When the engine speed reaches a predetermined level, a vacuum is created to activate a maximum speed governor. The maximum speed governor slows the engine speed by closing the engine throttle and further functions to operate a visual or audio warning indicator. Thus, this patent not only provides an indication of excess speed to a user, but also operates to decrease the engine operating speed below a predetermined maximum speed.

An engine overload condition differs from an excess engine speed condition in that the engine operating speed is too slow relative to the load being placed on the engine. For example, in an internal combustion engine used on a lawn mower, the ground speed of the mower may be too high relative to the power output from the mower. If tall grass is encountered during mowing, or a steep grade is encountered during transportation, the mower engine may be "lugged down" because the power output of the mower is insufficient under the operating conditions. Thus, in contrast with an excess engine speed condition, the speed of an internal combustion engine must be increased during an engine overload.

U.S. Pat. No. 3,281,783 generally discloses an engine overload indicator having a diaphragm responsive to engine vacuum pressure which operates a switch. The switch in turn operates a flasher and an audio alarm to alert an operator that an overload condition exists. The operator can then take corrective measures to increase the engine speed to an acceptable level by reducing the load on the engine, e.g., reducing the ground speed of the vehicle.

It is desired to provide an engine overload indicator that is compact and reliable for use in small internal combustion engines.

SUMMARY OF THE INVENTION

The present invention provides an overload warning apparatus for use in a small internal combustion engine, wherein the apparatus includes a signal generator that is mechanically actuable by a governor lever or throttle control plate upon movement of the throttle plate into its wide open position, whereupon a signal is generated to energize an indicator to provide an indication to a user that such overload condition exists.

Generally, the invention provides an internal combustion engine having a carburetor including a fuel-air mixture conduit therein. A throttle plate is disposed in the conduit for controlling the flow of the fuel-air mixture through the outlet opening of the conduit. A governor is mounted on the engine and includes an output lever that is operatively connected to the throttle plate for adjusting the throttle plate in accordance with engine speed. A signal generator is provided for generating an electrical signal in response to movement of the throttle plate into its wide open position. The signal energizes an indicator for indicating to an operator that the throttle plate is in its wide open position.

More specifically, the invention provides, in one form thereof, an electrical circuit including a switch, and an indictor electrically connected to the circuit. The switch is mounted adjacent the throttle control plate such that an outwardly extending leg of the plate engages and depresses the switch upon movement of the plate into its wide open position. Once depressed, the switch closes the circuit to energize an indicator, such as a light emitting diode or an audible alarm to alert an operator of the wide open throttle condition.

The invention provides, in another form thereof, an arrangement in which the switch is located adjacent the governor lever such that the governor lever depresses the switch upon movement of the lever to a position causing the throttle plate to be moved into its wide open throttle position.

An advantage of the overload warning apparatus of the present invention is that an operator is provided with an indication that a wide open throttle condition exists and can take corrective action to reduce the load placed on the engine.

Another advantage of the overload warning apparatus of the present invention is that inherent mechanical movement of the governor lever activates the switch means and modification of the governor lever is not required.

The present invention provides, in one form thereof, an internal combustion engine having a carburetor including a fuel-air mixture conduit having an outlet opening. A throttle plate is disposed in the conduit for controlling the flow of the fuel-air mixture through the outlet opening. The throttle plate is moveable between a closed position and a wide open position which permits a maximum flow of fuel-air mixture through the outlet opening. An electrical signal is produced in response to movement of the throttle plate into its wide open position. An indicator is energized by the electrical signal for indicating to the operator that the throttle plate is in its wide open position.

The present invention provides, in another form thereof, an internal combustion engine having a carburetor and a throttle plate as described above. In addition, the engine includes a governor mounted on the engine and driven thereby and responsive to engine speed. The governor includes an output lever that is operatively connected to the throttle plate for adjusting the throttle plate in accordance with engine speed. An electrical signal is produced in response to movement of the output lever into a position which causes the throttle plate to be moved into the wide open position. An indicator is energized by the electrical signal for indicating to an operator that the throttle plate is in the wide open position.

DETAILED DESCRIPTION OF THE INVENTION

Figure 1:
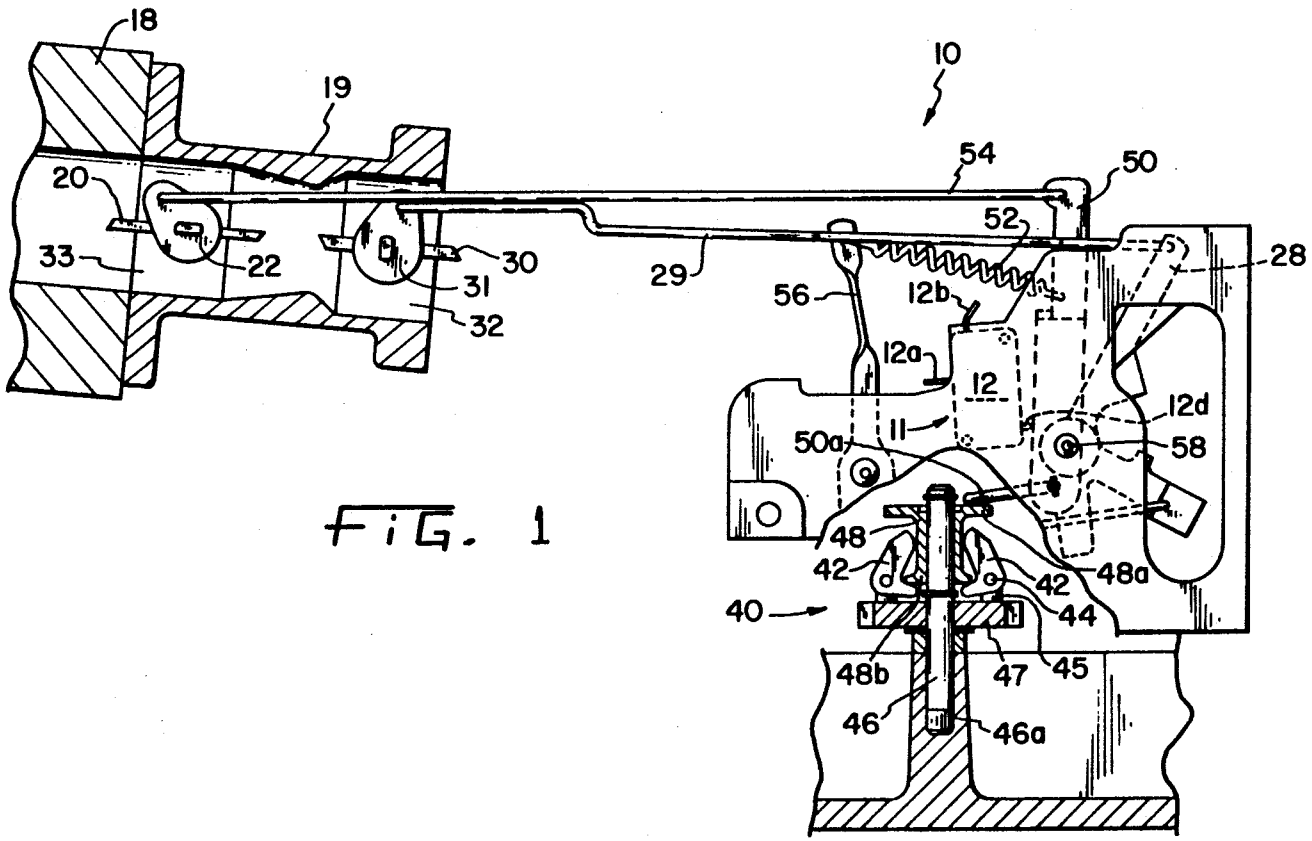
FIG. 1 is a partial cutaway view of a speed control assembly of an internal combustion engine, particularly showing an overload indicator switch being operable by a governor lever arm.

Referring now to the drawings and particularly to FIG. 1, there is shown a small internal combustion engine 10 of conventional design including a carburetor 18 with venturi section 19 fixed thereto, a governor assembly 40, a choke assembly, and a throttle assembly.

The throttle assembly includes a throttle plate 20, throttle control plate 22, and throttle control rod 54. The choke assembly is of conventional design and includes a choke plate 30, a choke control plate 31, a choke control rod 29, choke control lever 28, and air intake conduit 32.

Venturi section 19 includes air intake conduit 32, throttle plate 20 and throttle control plate 22, and choke plate 30 and choke control plate 31. Venturi section 19 may be rigidly fastened to carburetor 18 of engine 10 by conventional means, such as a plurality of threaded studs (not shown). As is customary, throttle plate 20 and choke plate 30 are adapted to rotate within air/fuel conduit 33 and air conduit 32, respectively.

Governor assembly 40 is of conventional design and functions in a manner similar to that shown in U.S. Pat. No. 4,517,942, issued to Pirkey, et al., assigned to the assignee of the present invention, which disclosure is incorporated herein by reference. For purposes of illustration, however, the operation of the governor assembly 40 (FIG. 1) will be generally described.

Governor assembly 40 is operable by engine 10 and is interconnected with and adapted to control the throttle plate 20. Governor assembly 40 generally includes flyweights 42, power input shaft 46, plate member 47, conventional spool member 48, and governor lever 50. Flyweights 42 are adapted to pivot about pin members 44 and coact with conventional spool member 48 which is adapted to longitudinally slide on power input shaft 46. Shaft 46 includes a helical gear 46*a*, for engaging with and receiving rotational input power from internal engine 10. Shaft 46 is rigidly fastened to plate member 47 which rotatably carries flyweights 42 by pins 44 extending through plate members 45. Flyweights 42 are generally L-shaped in cross-section and engage lower flange 48*b* of conventional spool member 48, thereby imparting an axial force against lower flange 48*b* during rotation of governor assembly 40.

Governor lever 50 is adapted to freely rotate about pin member 58 and includes a governor output shaft 50*a* rigidly attached thereto which imparts an axial force against top flange 48*a* counteracting the axial force imparted by flyweights 42. Speed control lever 56 is connected to governor lever 50 via a tension spring 52 and provides varying control of the axial force imparted by governor output shaft 50*a* against top flange 48*a* of spool member 48. Thus, the axial force imparted to top flange 48*a* is a function both of the tension in spring 5 which is imparted via speed control lever 56 and the relative axial position of spool member 48 which is slidably and rotatably carried by power input shaft 46.

At the beginning of operation, engine 10 is initially in an inoperative, i e., stopped condition. Rotational input power is therefore not transferred from engine 10 to power input shaft 46 of governor assembly 40. Because centrifugal force is not imparted to flyweights 42, the axial force imparted to conventional spool 48 via governor output shaft 50*a* causes flyweights 42 to be in a "closed" position (FIG. 1). As the rotational speed of power input shaft 46 and plate member 47 increases with the increasing engine speed, centrifugal forces exerted on flyweights 42 likewise increase The centrifugal forces imparted to flyweights 42 by the accelerating rotational speed of power input shaft 46 and plate member 47 increases, and the axial forces imparted by flyweights 42 against spool member 48 overcome the counteracting axial forces imparted by governor output shaft 50*a*. Axial movement of spool member 48 will cause governor lever 50 to rotate clockwise about pin 58. Clockwise rotation of governor lever 50 in turn causes throttle plate 20 to rotate clockwise within air intake conduit 32.

In accordance with an embodiment of the present invention, an overload warning apparatus 11 is provided, as shown in FIG. 1, and includes an indicator electrically connected to a switch which in turn is operable by a throttle assembly. Apparatus 11 is positioned such that the throttle assembly operates the switch, thereby activating an indicator when a wide open throttle condition occurs.

It is clarified that the term "wide open throttle condition" or "wide open throttle position" means an operating condition (and corresponding positional relationships of the throttle plate 20, governor assembly 40, and switch 12) that exists when the throttle plate is disposed in a predetermined position, such as generally parallel to the direction of fuel-air mixture flow through conduit 32, allowing a predetermined flow of air-fuel mixture through the conduit 32. A wide open throttle condition may occur, for example, when the rotational input speed from internal combustion engine 34 drops below a certain speed in a certain gear. Detection of a wide open throttle condition achieved by the present invention may correspond to any orientation of the throttle plate 20 within venturi section 19. FIG. 1 shows a throttle plate 20 during a wide open throttle condition which is positioned generally parallel to the direction of air flow through air intake conduit 32; however, it is possible to establish a different predetermined orientation of the throttle plate 20 corresponding to a different wide open throttle condition. For example, by varying the length of throttle control rod 54, the attachment location of throttle control rod 54 to throttle control plate 22, or the rotational limits of governor lever 50, it is possible to establish a predetermined wide open throttle condition in which the throttle plate 20 is disposed at some other angle within venturi section 19.

FIG. 1 depicts one embodiment of an overload warning apparatus 10 of the present invention wherein a wide open throttle condition is determined when the governor lever 50 of the governor assembly 40 is disposed in a predetermined position. In general, a switch 12, such as a micro-switch, is positioned adjacent the governor lever 50 to be operable by the governor lever when a wide open throttle condition occurs. When the governor lever 50 is in a wide open throttle position, micro-switch 12 is operated and activates an indicator 34. Similarly, when the governor lever is not in a wide open throttle position, micro-switch 12 is not operated and therefore does not activate indicator 34.

Figure 1A:
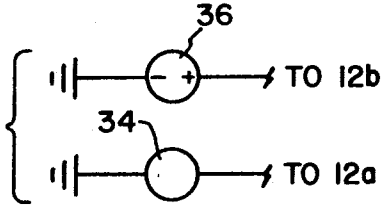
FIG. 1A is a schematic representation of the electrical circuit of the overload indicator of FIG. 1.

Micro-switch 12 is of conventional design providing a closed electrical circuit when plunger arm 12*d* is engaged. Referring to FIG. 1A, micro-switch 12 is provided with at least two electrical leads 12*a* and 12*b* disposed at the input and output sides thereof. Input electrical lead 12*b* is connected to and receives electrical input power from power source 36, such as a DC battery. Output electrical lead 12*a* is connected to and provides electrical power to indicator 34. In a preferred embodiment, the indicator 34 comprises an LED light positioned at a convenient location to provide a visual indicator to a user. However, other indicators may be used such as an audio alarm. Moreover, micro-switch 12 could optionally be provided with additional output electrical leads so that more than one indicator could be operated during a wide open throttle condition.

During operation of engine 10, governor assembly 40 and governor lever 50 operate as described above. When governor lever 50 is not in a wide open throttle position, plunger arm 12*d* of switch 12 is not depressed, and switch 12 therefore maintains an open circuit between input and output leads 12*a* and 12*b*. Accordingly, LED light 34 is not activated. On the other hand, when governor lever 50 is in a wide open throttle position, plunger arm 12*d* of switch 12 is depressed, and the circuit is closed between input and output leads 12*a* and 12*b* of switch 12. Accordingly, LED light 34 is activated and a user may take corrective action to eliminate the wide open throttle condition.

A wide open throttle condition during operation of the internal combustion engine can occur, as indicated above, by an engine overload condition. Upon such an engine overload condition, the rotational speed of power input shaft 46 and associated centrifugal forces acting on flyweights 42 are reduced, thereby allowing the axial forces imparted to spool 48 by governor output shaft 50*a* to overcome the axial forces imparted to spool 48 by flyweights 42 and move the governor assembly 40 to a wide open throttle position. In this case, governor lever 50 rotates counterclockwise to engage plunger arm 12*d* of switch 12 and thereby activate indicator 34 to provide an indication that a wide open throttle condition exists.

Figure 2:
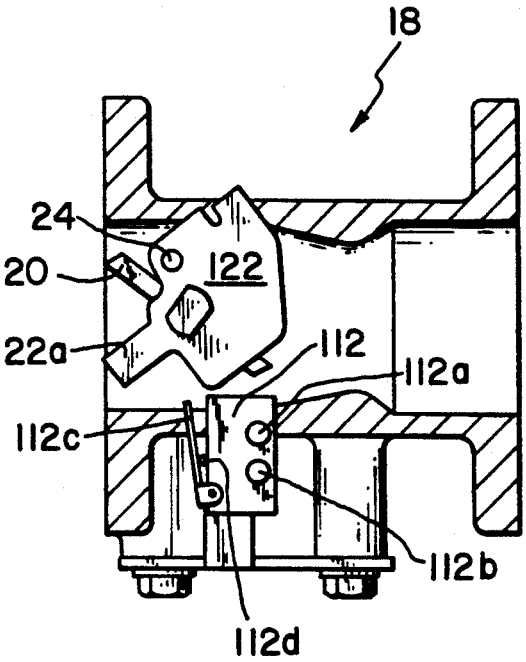
FIG. 2 is an alternative embodiment of that shown in FIG. 1, wherein an overload indicator switch is adapted to be engaged by a throttle control lever.
Figure 3:
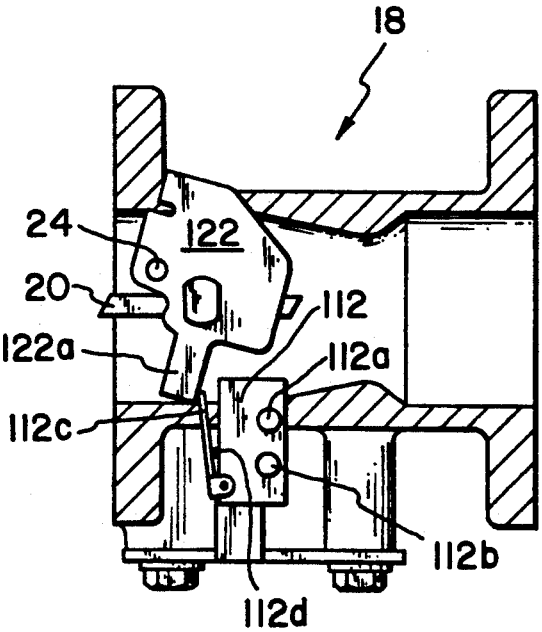
FIG. 3 represents the overload warning apparatus of FIG. 2, wherein the throttle control lever is shown engaging the switch while the throttle plate is in a wide open position.

FIGS. 2 and 3 show partial cut-away views of an alternative embodiment of the invention wherein a switch 112 coacts with and is operable by a throttle control plate 122. FIG. 2 shows a throttle plate 20 and throttle control plate 122 when the throttle plate 20 is not a wide open throttle condition. In this position, outwardly extending leg portion 122*a* of throttle control plate 122 does not operate lever arm 112*c* of switch 112. The electrical circuit between electrical leads 112*a* and 112*b* therefore remains open, and LED light 34 is not activated.

FIG. 3 shows the throttle plate 20 and throttle control plate 122 during a wide open throttle condition. Outwardly extending leg portion 122*a* of throttle control plate 122 is adapted to engage lever arm 112*c* of switch 112 during a wide open throttle condition. Lever arm 112*c* in turn depresses plunger arm 112*d* of switch 112 and closes the electrical circuit between input and output electrical leads 112*a* and 112*b*. LED light 34 is thereby activated, and a user is alerted that a wide open throttle condition exists. The load placed on engine 10 may then be manually decreased by a user, e.g., shifting to a lower gear to ensure that damage does not occur to engine 10.

Although throttle control plate 122 is shown in FIGS. 2 and 3 with an outwardly extending leg portion 122*a*, different geometric configurations could also be used. For example, throttle control plate 122 could be rectangular or square in shape with switch 112 mounted such that lever arm 112*c* is engaged by one surface of throttle control plate 122 when the throttle plate 20 is in a wide open throttle position. In addition to activating switch 112 with the throttle control plate 122 or the governor lever 50, it is also possible to activate the governor lever with, for example, an outwardly extending lug that is rigidly fixed to throttle control rod 54.

It will be appreciated that the foregoing is presented by way of illustration only, and not by way of any limitation, and that various alternatives and modifications may be made to the illustrated embodiment without departing from the spirit and scope of the invention.

What is claimed is:

1. An internal combustion engine, comprising:

a carburetor including a fuel-air mixture conduit having an outlet opening;

a throttle plate in said conduit for controlling the flow of the fuel-air mixture through said outlet opening, said throttle plate being movable between a closed position and wide open position which permits a predetermined flow of fuel-air mixture through said outlet opening;

governor means mounted on the engine and driven thereby and responsive to engine speed, said governor means being operatively connected to the throttle for adjusting the throttle in accordance with engine speed;

a switch that is mechanically actuated by engagement of said throttle plate into said wide open position, wherein actuation of said switch produces an electrical signal; and means energized by said electrical signal for indicating to an operator that said throttle plate is in said wide open position.

2. The engine of claim 1, wherein said throttle plate includes an outwardly extending leg portion, and said switch includes a depressible lever arm for mechanical actuation, wherein said leg portion depresses said lever arm upon movement of said throttle control plate into said wide open position.

3. The engine of claim 1, wherein said indicating means is a light emitting diode.

4. The engine of claim 1, wherein said indicating means is an audio alarm.

5. The engine of claim 4, wherein said switch comprises a micro-switch.

6. An internal combustion engine, comprising:

a carburetor including a fuel-air mixture conduit having an outlet opening;

a throttle in said conduit for controlling the flow of the fuel-air mixture through said outlet opening, said throttle being moveable between a closed position and a wide open position which permits a predetermined flow of fuel-air mixture through said outlet opening;

governor means mounted on the engine and driven thereby and responsive to engine speed, said governor means including an output lever that is operatively connected to said throttle for adjusting said throttle in accordance with engine speed;

a switch that is mechanically actuated by engagement of said governor lever upon movement of said throttle into said wide open position, wherein actuation of said switch produces an electrical signal; and means energized by said electrical signal for indicating to an operator that said throttle is in said wide open position.

7. The engine of claim 6, wherein said switch includes a plunger arm which is depressed by said output lever upon movement of said output lever to said wide open position.

8. The engine of claim 6, wherein said indicating means is a light emitting diode.

9. The engine of claim 6, wherein said indicating means is an audio alarm.

10. The engine of claim 9, wherein said switch comprises a micro-switch.

* * * * *